US009884243B2

(12) United States Patent
Wariakois

(10) Patent No.: US 9,884,243 B2
(45) Date of Patent: Feb. 6, 2018

(54) SPLITBOARD BINDING WITH STEP IN REAR SECURING FEATURE AND LOCKING CRAMPON

(71) Applicant: Mark J. Wariakois, Salt Lake City, UT (US)

(72) Inventor: Mark J. Wariakois, Salt Lake City, UT (US)

( * ) Notice: Subject to any disclaimer, the term of this patent is extended or adjusted under 35 U.S.C. 154(b) by 0 days.

(21) Appl. No.: 15/399,391

(22) Filed: Jan. 5, 2017

(65) Prior Publication Data

US 2017/0189788 A1 Jul. 6, 2017

Related U.S. Application Data

(60) Provisional application No. 62/274,985, filed on Jan. 5, 2016.

(51) Int. Cl.

| | |
|---|---|
| ***A63C 5/03*** | (2006.01) |
| ***A63C 10/24*** | (2012.01) |
| ***A63C 5/02*** | (2006.01) |
| ***A63C 10/14*** | (2012.01) |
| ***A63C 9/02*** | (2012.01) |

(52) U.S. Cl.

CPC ..... *A63C 5/031* (2013.01); *A63C 5/02* (2013.01); *A63C 9/02* (2013.01); *A63C 10/14* (2013.01); *A63C 10/24* (2013.01); *A63C 2203/06* (2013.01); *A63C 2203/50* (2013.01)

(58) Field of Classification Search

CPC ..... A63C 5/02; A63C 5/03; A63C 10/14
See application file for complete search history.

(56) References Cited

U.S. PATENT DOCUMENTS

| | | | | |
|---|---|---|---|---|
| 5,035,443 A * | 7/1991 | Kincheloe | ..... | A63C 10/02 280/14.22 |
| 5,297,812 A * | 3/1994 | Dogat | ..... | A63C 9/00 280/633 |
| 5,505,478 A * | 4/1996 | Napoliello | ..... | A63C 10/10 280/14.22 |
| 5,649,722 A * | 7/1997 | Champlin | ..... | A63C 5/02 280/14.22 |
| 5,741,023 A * | 4/1998 | Schiele | ..... | A63C 9/02 280/14.21 |

(Continued)

FOREIGN PATENT DOCUMENTS

| | | | | |
|---|---|---|---|---|
| EP | 1080750 A2 * | 3/2001 | ..... | A63C 10/14 |

*Primary Examiner* — Katy M Ebner
(74) *Attorney, Agent, or Firm* — Morriss O'Bryant Compagni

(57) ABSTRACT

Splitboard binding systems and assemblies for use in ski mode or snowboard mode. Left and right bottom rails are attached to the bottom surface of a base plate. Each rails may have a circular hook at a forward end for attachment to a toe bracket in a ski mode. The rails and base plate define channels for slidable attachment to "pucks" disposed on the gliding board in snowboard mode. A securing lever disposed near the rear end of the binding with a securing member disposed on the lower surface thereof may be rotated into a downwards position so the securing member resides below the base plate to secure the binding in position when installed on "pucks" in a snowboard mode. Crampon assemblies and sliding heel locks for use with the binding assembly are aso disclosed.

20 Claims, 7 Drawing Sheets

(56) References Cited

U.S. PATENT DOCUMENTS 5,984,324 A * 11/1999 Wariakois ..... A63C 5/02 280/14.24
6,523,851 B1 * 2/2003 Maravetz ..... A63C 5/02 280/14.22
6,557,866 B2 * 5/2003 Jones ..... A63C 10/10 280/14.22
7,681,904 B2 3/2010 Ekberg
7,823,905 B2 * 11/2010 Ritter ..... A63C 5/02 280/14.26
8,011,676 B1 * 9/2011 Keast ..... A63C 10/14 280/14.22
8,033,564 B2 * 10/2011 Riepler ..... A63C 5/02 280/603
8,122,773 B2 3/2012 Wyatt et al.
8,226,109 B2 * 7/2012 Ritter ..... A63C 5/02 280/14.26
8,348,299 B2 1/2013 Ekberg
8,469,372 B2 * 6/2013 Kloster ..... A63C 5/02 280/14.22
8,708,371 B2 * 4/2014 Balun ..... A63C 5/033 280/14.21
8,764,043 B2 * 7/2014 Neubauer ..... A63C 10/16 280/607
9,022,412 B2 * 5/2015 Ritter ..... A63C 5/02 280/14.26
9,079,094 B2 7/2015 Ekberg
9,114,305 B2 * 8/2015 Keffler ..... A63C 5/02
9,126,099 B2 * 9/2015 Ritter ..... A63C 5/02
9,132,336 B2 * 9/2015 Bulan ..... A63C 5/02
9,220,968 B2 * 12/2015 Ritter ..... A63C 10/12
9,327,181 B2 * 5/2016 Chickering-Ayers A63C 9/0847
2004/0056451 A1 * 3/2004 Baikhardt ..... A63C 10/14 280/618
2005/0046149 A1 * 3/2005 Ekberg ..... A63C 5/00 280/601
2005/0285373 A1 * 12/2005 Miller ..... A63C 10/10 280/623
2007/0187911 A1 * 8/2007 Morley ..... A63C 10/18 280/14.24
2007/0216137 A1 9/2007 Ritter
2008/0122202 A1 * 5/2008 Furr ..... A63C 10/12 280/626
2008/0277904 A1 * 11/2008 Etges ..... A63C 10/10 280/613
2009/0026731 A1 * 1/2009 Stewart, III ..... A63C 5/06 280/611
2009/0140503 A1 6/2009 Kolesar et al.
2009/0250906 A1 10/2009 Ritter
2010/0102522 A1 4/2010 Kloster et al.
2011/0018232 A1 1/2011 Prigge et al.
2012/0211969 A1 * 8/2012 Walker ..... A63C 10/145 280/623
2012/0256395 A1 10/2012 Ritter
2012/0274036 A1 11/2012 Kloster et al.
2015/0343297 A1 * 12/2015 Ekberg ..... A63C 9/00 280/618
2016/0129336 A1 * 5/2016 Etallaz ..... A63C 5/02 280/14.22
2016/0175690 A1 * 6/2016 Ritter ..... A63C 5/031 280/618
2016/0199722 A1 * 7/2016 Ritter ..... A63C 9/10 280/617

* cited by examiner

SPLITBOARD BINDING WITH STEP IN REAR SECURING FEATURE AND LOCKING CRAMPON

CROSS-REFERENCE TO RELATED APPLICATION

This application claims the benefit of U.S. Provisional Application No. 62/274,985, filed Jan. 5, 2016, the disclosure of which is incorporated herein by reference in its entirety.

TECHNICAL FIELD

This invention relates to ski equipment, and specifically relates to an improved boot binding for use with splitboards.

BACKGROUND

Snowboarding is a very popular winter recreational sport that was developed in the 1980's. The more commonly used snowboards are structured as a single board having binding assemblies attached to the board for receiving the boots of the snowboarder (also referred to herein as the "rider").

Another popular form of snowboarding involves the use of what is known as a splitboard, which comprises two separate and conjoinable boards. When separated, the two boards are skis; when conjoined together, the boards form a snowboard. Splitboards provide the user with the alternative of using the skis in a traditional skiing mode, or joining the skis for use as a snowboard. The dual configuration of splitboards is particularly useful for using the separate skis for alpine touring into a desired area, then joining the skis into the snowboard configuration to snowboard down a terrain.

U.S. Pat. No. 5,984,324, the contents of which are incorporated herein by reference, discloses a splitboard binding assembly that has become essentially the industry standard for attachment of boot bindings between the skiing and the snowboarding modes of a splitboard. That is, splitboards are provided with a boot binding assembly that secures the boot to the board along its longitudinal axis when in the skiing mode, and is also provided with a boot binding assembly for the snowboarding mode that comprises a pair of toe pucks attached to one ski and a pair of heel pucks attached to the other ski. When the two skis are positioned side-by-side and secured together for use in the snowboarding mode, each toe puck aligns with a respectively positioned heel puck, and a boot binding is then slid onto an aligned heel and toe puck so that the boot binding spans the two skis.

The '324 patent discloses an exemplary snowboard binding arrangement that comprises a slider plate formed with sides that are curved to form a U-shaped channel on either side of the slider plate. The U-shaped channels are sized to be received on laterally extending flanges on the aligned heel and toe pucks. When the slider plate of the binding is fully engaged on the heel and toe puck, a pin is positioned through holes formed in the forward end of the slider plate to secure the slider plate relative to the heel and toe pucks.

U.S. Pat. No. 7,823,905, the contents of which are incorporated herein by reference, also describes a boot binding construction for a splitboard where the lower portion of the binding is structured for sliding onto the heel and toe pucks as taught by the '324 patent. The binding of the '905 Patent comprises a sandwich box girder comprised of a top plate, a center spacer core further comprising two separated lateral spacers, and a bottom plate is U-shaped in planar formation to provide a backstop for contacting the heel puck of the binding assembly. The stated objectives of the binding of the 905 Patent are to provide a lightweight construction, essentially provided by the lateral spacers being made of an ultra high molecular weight (UHMW) plastic, and to provide torsional stiffness in the boot binding. The binding of the 905 Patent, while presumably providing a lighter weight binding, nonetheless comprises an assemblage of plates and lateral webs that require fairly precise assemblage of the parts with precision placement of screws to attach the lateral webs and bottom plate to the top plate. The assemblage represents a plurality of parts that must be separately manufactured and assembled, which increases manufacturing costs.

U.S. Pat. No. 9,126,099, the contents of which are incorporated herein by reference, also discloses a splitboard binding that uses a single toe pedal mechanism to secure binding into either the snowboard or ski mode. Such assemblage requires a plurality of specialized parts, with an increased manufacturing cost.

U.S. Pat. No. 8,764,043, the contents of which are incorporated herein by reference, discloses a splitboard binding that eliminates the need for a locking mechanism on the toe for ski mode attachment, by using a circular hook portion that engages with a circular channel on a toe bracket attached to the gliding board, that only engage or disengage at a predetermined angle in excess of one reached during use.

Bindings or binding systems that which are simple to use and easy to operate under harsh conditions would be an improvement in the art.

SUMMARY

The present disclosure is directed to a splitboard binding that may be attached to either a left or right gliding board in a ski mode or to both the left and right gliding board in a snowboard mode. Left and right bottom rails are attached to the bottom surface of a base plate. Each of the left and right rails has a circular hook at a forward end for attachment to a toe bracket in a ski mode. The rails and base plate define channels for slidable attachment to "pucks" disposed on the gliding board in snowboard mode. A securing lever is disposed near the rear end of the binding with a securing member disposed on the lower surface thereof. When the securing lever is rotated into a downwards position, the securing member resides below the base plate. When installed on "pucks" in a snowboard mode, the securing member secures the binding in position on the pucks. Rotating the securing lever upwards raises the securing member allowing the binding to be removed.

Additionally, a crampon assembly may be included for use in a ski or snowshoeing mode which attaches to the toe bracket underneath the binding. The crampon may include one or more locks for attachment to the rails of the binding. The assemblies may further include a rear sliding lock positioned on the left or right board near the rear of the binding which may be used to secure the heel of the binding where desired.

DESCRIPTION OF THE DRAWINGS

It will be appreciated by those of ordinary skill in the art that the various drawings are for illustrative purposes only. The nature of the present disclosure, as well as other embodiments in accordance with this disclosure, may be more clearly understood by reference to the following detailed description, to the appended claims, and to the several drawings.

DETAILED DESCRIPTION

The present disclosure relates to apparatus, systems and methods for snowboard and splitboard bindings. It will be appreciated by those skilled in the art that the embodiments herein described, while illustrative, are not intended to so limit this disclosure or the scope of the appended claims. Those skilled in the art will also understand that various combinations or modifications of the embodiments presented herein can be made without departing from the scope of this disclosure. All such alternate embodiments are within the scope of the present disclosure.

Figure 1:
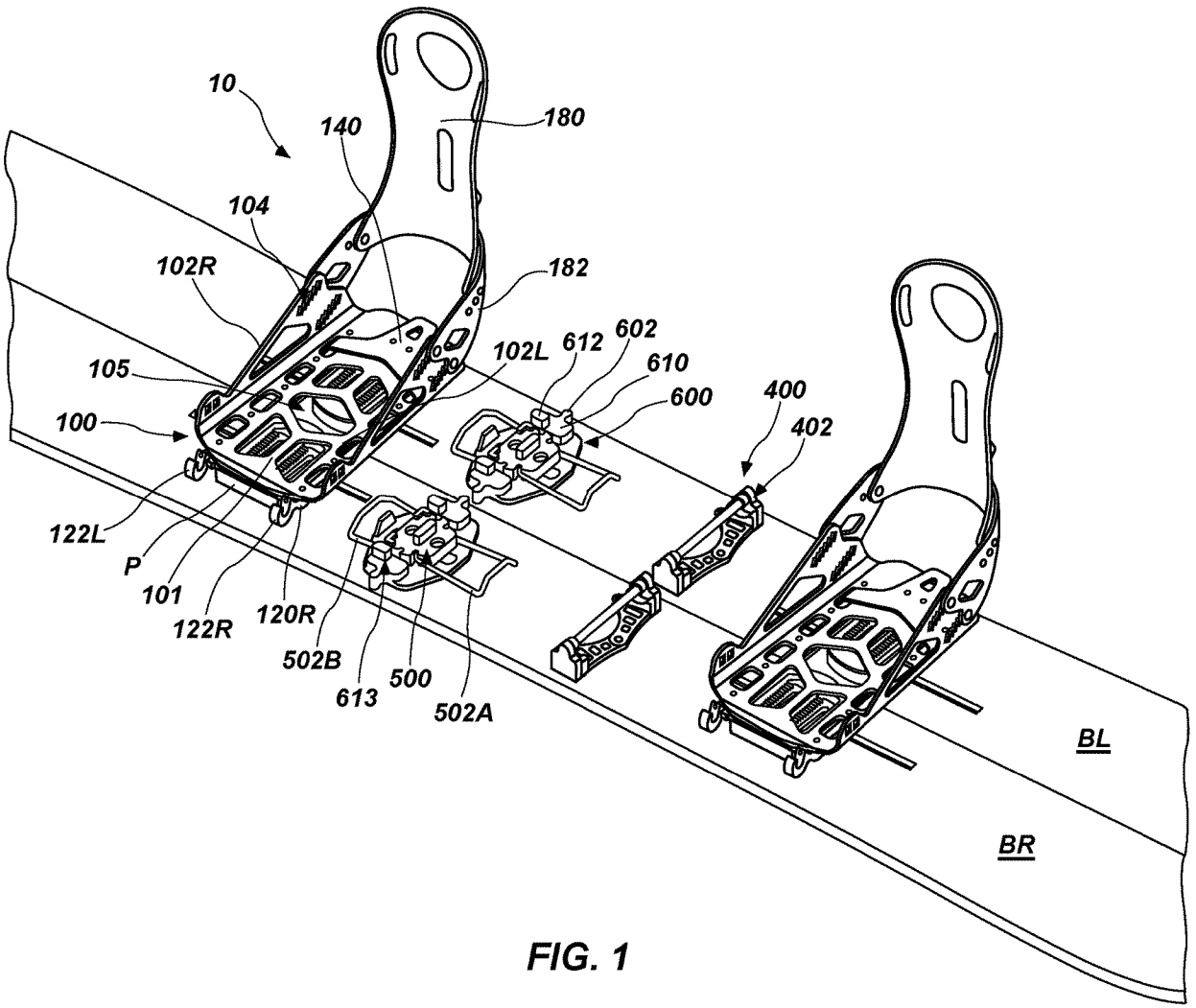
FIG. 1 depicts a perspective view of a splitboard binding in accordance with the present disclosure in position on a splitboard in a gliding confirmation.
Figure 1A:
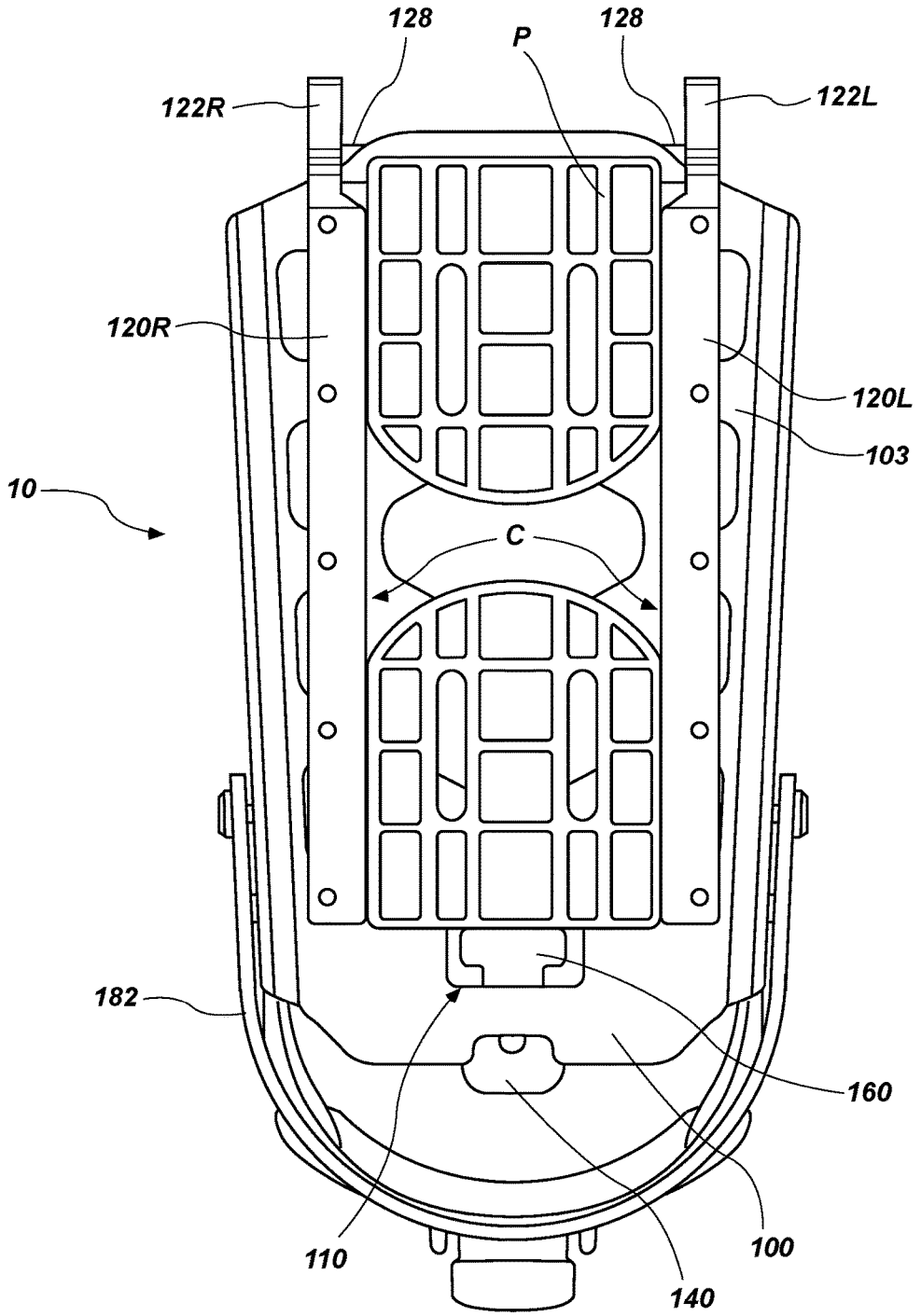
FIG. 1A depicts a bottom view of a splitboard binding of FIG. 1 in position with the "pucks" for slidable attachment to a gliding board.
Figure 2:
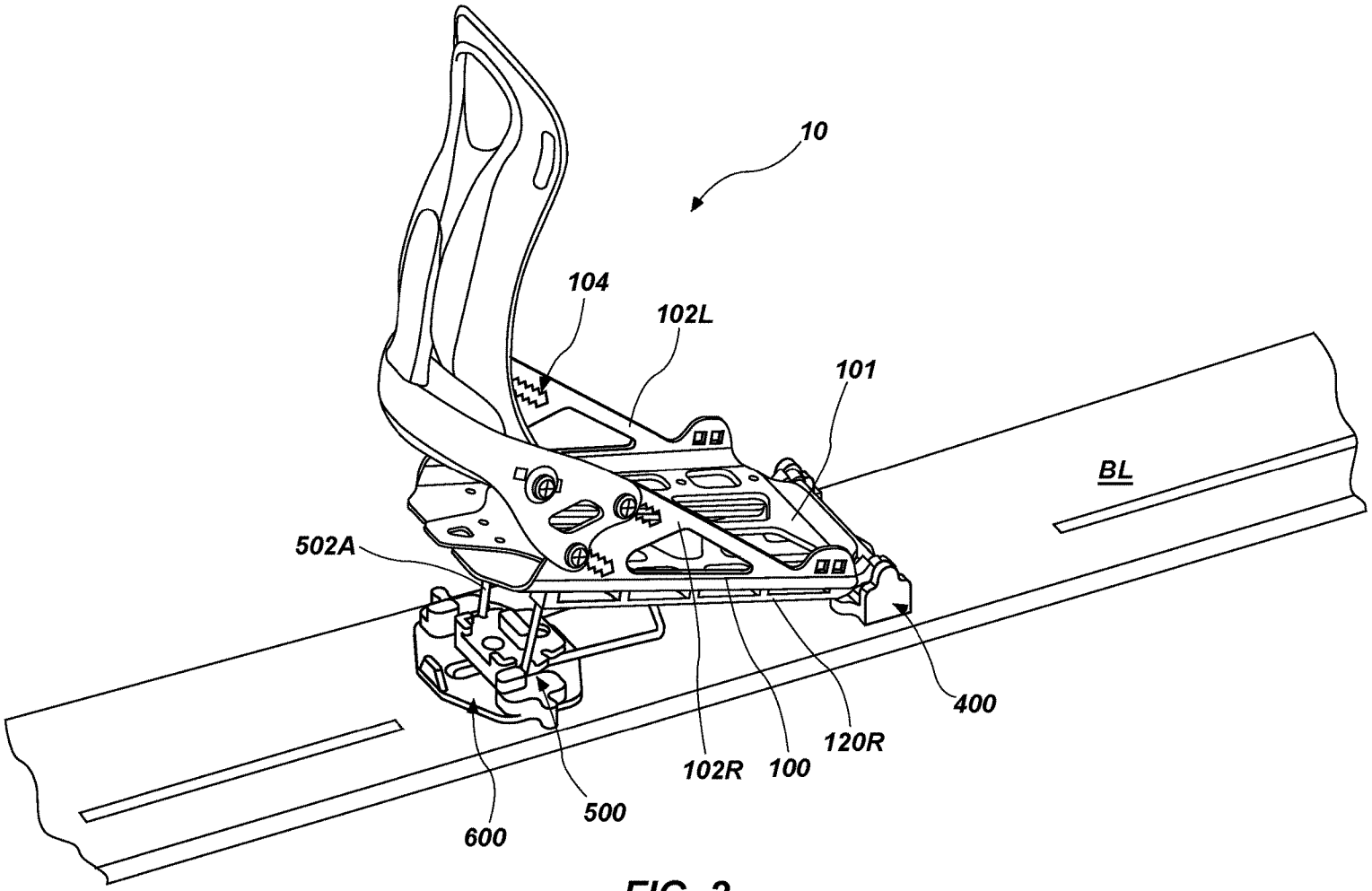
FIG. 2 depicts a perspective view of a splitboard binding of FIGS. 1 and 1A in position on a splitboard in a skiing confirmation.
Figure 7:
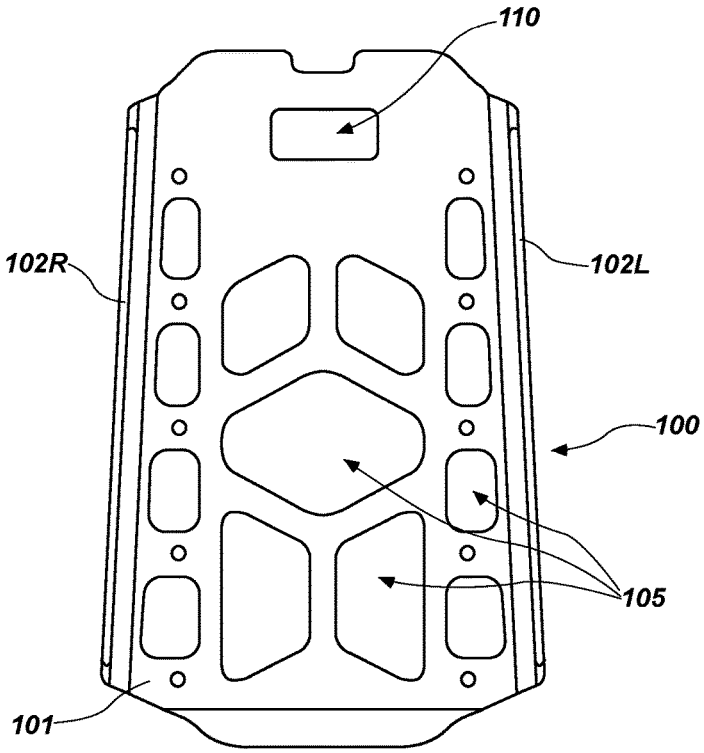
FIG. 7 is a top view of the base plate of the binding of FIGS. 1 and 2 in isolation.

Turning to FIGS. 1, 1A and 2, a first embodiment of a splitboard binding 10 in accordance with this disclosure is depicted. The binding 10 may be attached to either a left or right gliding board BL or BR in a ski mode or to both the left and right gliding board in a snowboard mode. It will be appreciated that in a typical installation two bindings 10 will be used with a single splitboard assembly. A base plate 100 (depicted in isolation in FIG. 7) has a generally planar upper surface 101 for receiving a user's foot, typically in a snow boot, and a corresponding planar lower surface 103. At least one connection opening 110 (FIG. 7) is formed in the planar section to allow for connection to a gliding board, as will be discussed further herein. Additionally, a number of other openings 105 may be formed in the planar section to reduce the weight of the binding 10 and allow any snow on the sole of a user's boot to pass therethrough in use.

At either side surface of the planar section, a sidewall 102L or 102R may be disposed as a generally orthogonal wall. Where present, the sidewalls 102L or R may contain strap openings 104, allowing for connection to securing straps or other securing structures to retain a user's foot in the binding 10. It will be appreciated that the planar section may include different openings or structures for connection to other types of securing features for use as a plate-type binding or a strap-type binding. For example a highback 180 may be attached using a rear strap 182.

Figure 4A:
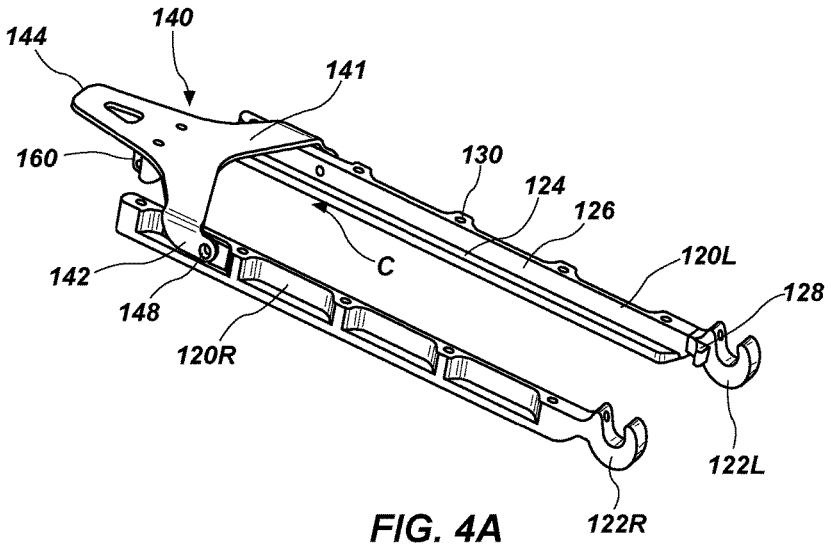
FIGS. 4A and 4B are perspective views of the bottom rails and securing lever of the binding of FIGS. 1 through 3.
Figure 4B:
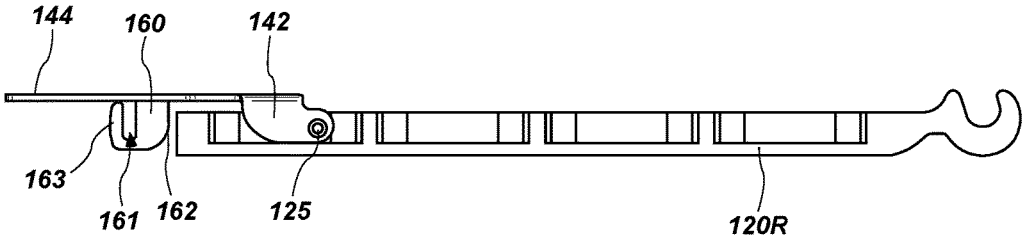
Figure 5:
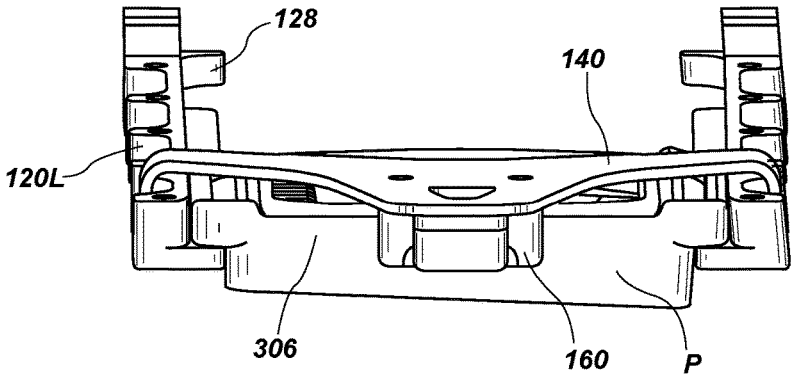
FIG. 5 is a rear view of one of the bottom rails and securing lever of the binding of FIGS. 1 through 4B in position with a puck.

Left and right bottom rails 120L and 120R are attached to the bottom surface of the base plate 100, and are depicted in more detail isolation in FIGS. 4A, 4B and 5. Each of the left and right bottom rails 120L or 120R has a circular hook 122 at a forward end thereof for attachment to a toe bracket 400 in a ski mode, as depicted in FIG. 2. The hooks 122 allow the binding 10 to attach to the separated members of the gliding board for ski mode attachment, by using the circular hooks 122 with a circular channel 402 on a toe bracket 400 attached to the gliding board, as disclosed in U.S. Pat. No. 8,764,043, the contents of which are incorporated by reference herein in its entirety. The binding can then only engage or disengage at a predetermined angle in excess of one reached during normal use. This removes the need for additional toe connection structures and eases use in the field under snowy conditions.

Each bottom rail 120L or 120R is formed as an elongated member extending from the forward hook 122 to a distal end. The interior side of the elongated member is defined by a sidewall 126 and a lower ledge 124. In the depicted embodiment, the sidewall 126 is generally vertical with the lower ledge 124 formed as a planar member along at least a portion of the interior surface and extending towards the center of the binding 10. The ledge 124 and sidewall 126 define a channel C in connection with the bottom surface of the base plate 100. This channel is open at the rear end of the binding, where the sidewall 126 curves outward to facilitate a connection as discussed further herein. Near the front end, a stop 128 may be disposed on the sidewall 126, to define an end to the channel. As depicted the stop 128 may be curved to correspond to a puck, as discussed in more detail further herein.

In the depicted embodiment, the sidewall 126 and lower ledge 124 have generally planar surfaces and are disposed at generally right angles to one another. These thus define the insertion channel C that corresponds to a depicted "puck" P. It will be appreciated that in other embodiments, where the puck has a different shape, the rails may similarly vary to define a suitable channel.

Each bottom rail 120 may further include connection structures allowing it to be connected to the base plate 100. In the depicted embodiment, these include screw holes 130.

Figure 6:
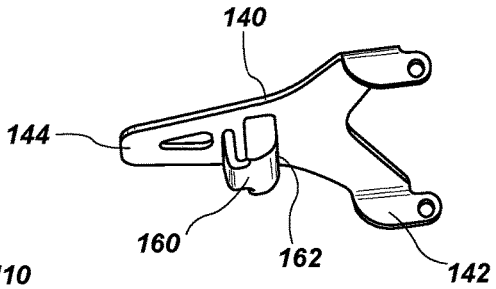
FIG. 6 is a bottom perspective view of the securing lever of the binding of FIGS. 1 through 5 in isolation.

A securing lever 140 is best depicted in FIG. 6, and is shown in relationship to the bottom rails 120L and 120R in FIGS. 4A, 4B and 5. The securing lever 140 may include two counterpart hinge tabs, 142, formed as vertical portions including a hinge point 148, which are connected to each of the bottom rails 120 at a hinge connection point 125 by a suitable structure, such as a hinge pin. Each hinge tab is connected to a generally planar portion 141. In the depicted embodiment, this connection is formed by a bend in a single piece of material, although it will be appreciated that these can be formed by joined separate pieces.

Figure 3:
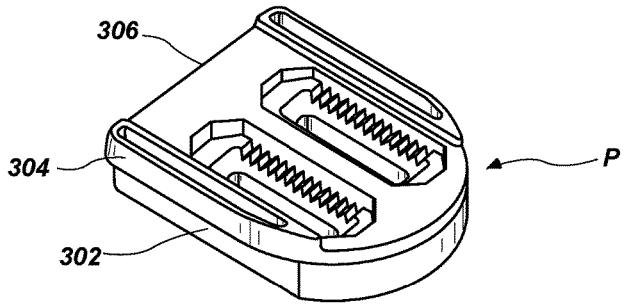
FIG. 3 is a perspective view of the puck shown in FIGS. 1 and 1A.

Planar portion 141 ends in a rear tab 144 and has a puck lock member or stop 160 disposed on a lower surface thereof. The puck lock member 160 may be attached to the securing lever 140 by rivets, screws, or as otherwise known in the art. In some embodiments, it may be integrally formed, or it may be a replaceable member. The puck stop 160 may have a front face 162 that is formed as a generally vertical sidewall with a shape corresponding to the rear face 306 of a puck P (FIG. 3). Additionally, puck stop 160 may have a separate rear member 163 that is separated from the stop main body along the upper portion and resiliently connected to a lower portion thereof to define a space 161 between the rear member 163 and the body of the stop 160.

In use, the puck stop 160 may pass through the connection opening 110 in the planar member 100 as the securing lever 140 rotates towards and away from the planar member 103.

It will be appreciated that although a single, centrally located puck stop 160 is depicted in the drawings, that in other embodiments, multiple puck stops 160 can be used. For example, two or more separate puck stops 160 disposed at different locations on the securing lever 140 could be used to secure the rear face 306 of the puck P. Such stops 160 could pass through a single opening in the planar member 100 or through multiple separated openings as the securing latch 140 rotates downwards. In some embodiments, the inner face 162 of two separate stops 160 could have a generally L-shaped sidewall that is disposed at the corners of the rear face 306 and extends along the sidewalls of the puck P for securing.

In other embodiments, the securing lever 140 could be configured to rotate one or more stops 160 to a securing position behind the puck P from the sides of the binding 10 rather than downwards through the rear of the planar member 100. For example, the securing latch 140 could be configured to rotate downwards in a direction that is generally orthogonal, rather than parallel, to the long axis of the binding, moving the stop 160 in from the side. In one such embodiment, two securing levers 140 could be used, each moving a separate stop 160 behind the puck P from an opposite side, either passing downwards through openings in the planar member 100 or passing around the side edges thereof distal to the bottom rails 120.

For use with a splitboard, a binding system 10 is used in the split configuration for ski mode by attachment of the hooks 122 of the rails 120 to a circular channel on a toe bracket attached to the gliding board, as disclosed in U.S. Pat. No. 8,764,043 and as best depicted in FIG. 2. A user then places the foot on the upper surface 101 planar member 100 and secures it thereto, as by straps. The binding 10 rotates with the heel free for use in ski mode. After use, the foot is removed from the planar member 100 and the binding 10 released from the toe bracket by rotation.

As further depicted in FIG. 2, during use in the "free heel" mode, the rear portion of the binding 10 may contact a heel bracket 500 that is disposed on the board BL or BR. The heel bracket may include one or more projections or planar areas for contacting the bottom of the binding 10 to protect and reduce wear on the board. Additionally, the heel bracket 500 may include one or more elevation assemblies 502A or 502B. In the depicted embodiment, these are constructed of a folding member that can be disposed in a lower undeployed position or can be rotated to a raised deployed position to provide an elevated stop for the bottom of the binding 10 during use. An elevated stop can thus assist the user when traversing up an inclined surface in a ski or snowshoe type use of the board. The use of multiple elevation assemblies can allow for use in different inclines. As depicted, a sturdy tubular member that is bent into a suitable shape and resiliently passes into and out of locking recesses in the heel bracket 500 may be used to form the elevation assemblies.

For use in snowboard or glide mode, the two halves of the splitboard are joined together with a puck P on either half aligned in position to a counterpart puck P on the other half for placement of the binding. A binding system 10 is then slidably attached to the aligned pucks P by placing the open rear end of the insertion channels C defined by the sidewall 126 and lower ledge 124 of the rails 120 and lower surface of the base plate base in contact with the pucks, with the securing lever 140 raised to an upper position with puck stop 160 clear of the puck P. The side ledges 304 of puck P thus resides in the binding 10 channels C as the binding is slid rearward until the front puck contacts stop 128. The securing lever 140 is rotated into a downwards position, until the securing stop 160 resides below the planar base 100 with the front face 162 abutting the rear face 306 of puck P. This rotation may occur as a foot is pressed down into the binding 10. When installed on "pucks" P in a snowboard mode, the binding is secure in position on the pucks, as best depicted in FIG. 1A. For removal, a user removes a foot from the binding 10, and rotates the securing lever 140 upwards raising the securing stop 160 and allowing the binding 10 to be removed by sliding it forwards.

It will be appreciated that the various components including rails 120, planar member, 100, securing lever 140, and stop(s) 160 may all be separate members that are modular, removable and replaceable, allowing a user to repair or service the binding system in the field.

Figure 8A:
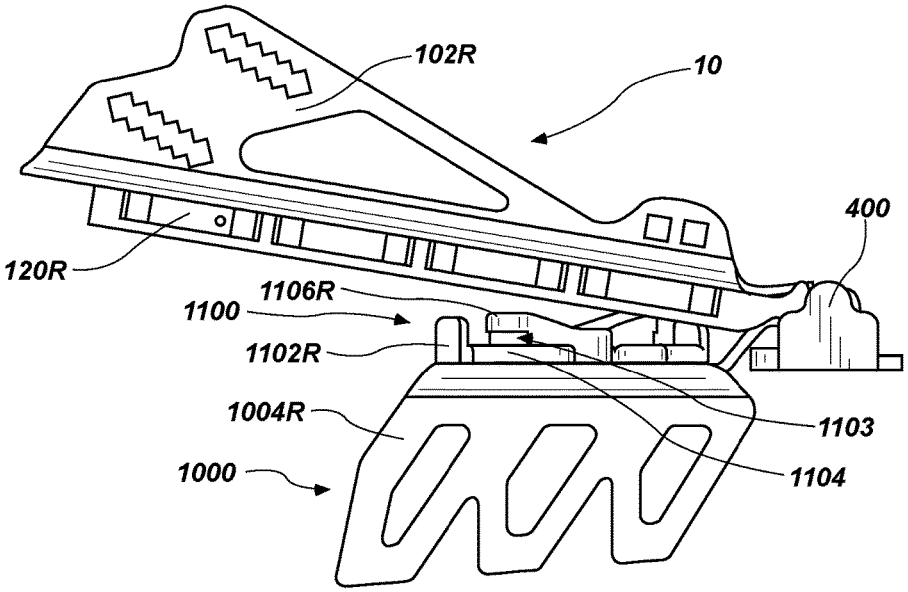
FIG. 8A is a side view of the binding system of FIGS. 1 and 2 in position with a crampon assembly for use in a ski mode.
Figure 8B:
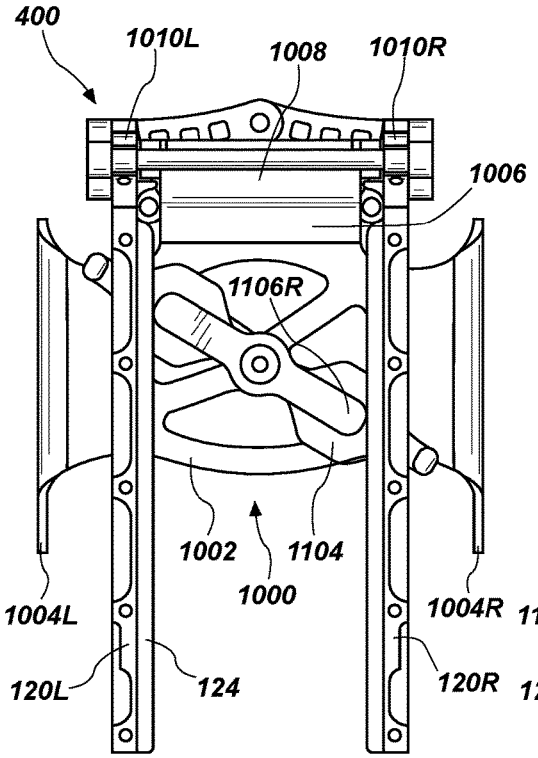
FIGS. 8B and 8C are top views of the bottom rails and toe bracket of the binding system of FIGS. 1 and 2 in position with the crampon assembly of FIG. 8A.
Figure 8C:
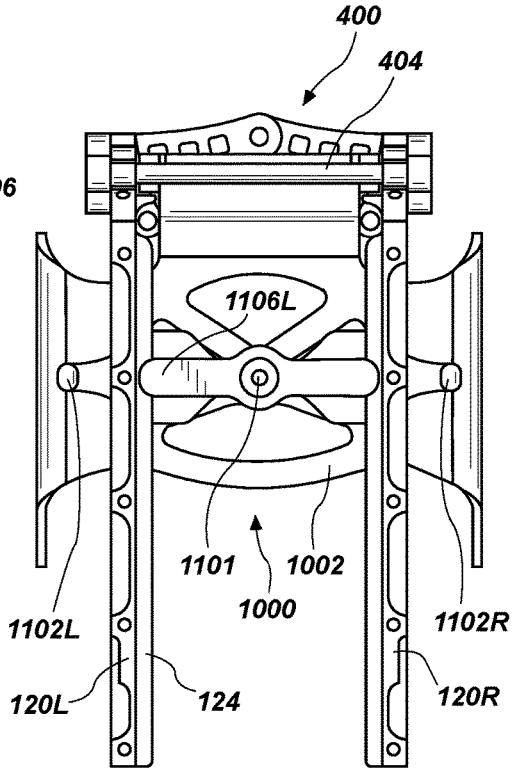

Turning to FIGS. 8A, 8B, and 8C, a crampon assembly 1000 for use with the binding assembly of the present disclosure is depicted. Two side members 1004R and 1004L extend downwards at the right and left sides, respectively, from a central planar section 1002. It will be appreciated that the central planar section will have a sufficient width to extend past the side edges of a board BL or BR in skiing conformation such that the side members 1004R and 1004L will extend downwards past the board to contact snow and provide traction to a user. As depicted, the side members 1004R or 10074L may include multiple cutting surfaces and recesses for providing traction to the user.

As a front edge of the planar member 1002 a slanted member 1006 may extend upwards to a planar connection member 1008. It will be appreciated that the planar member 1002, side members 1004R and 1004L, slanted member and planar connection member may be formed as a single continuous piece, as by bending suitable metal sheet or as is otherwise known in the art.

As depicted, for installation the planar connection member 1008 may be placed in the toe bracket 400 residing under a central portion of the rod 404 that defines the circular channels (where present). At either end, it may have member 1010R and 1010L that rise to define a channel around a portion of the rod 404.

Upon installation, the planar member 1002 resides under the binding 10. As best depicted in FIGS. 8B and 8C a rotatable locking member 1100 may be present and used to secure the crampon assembly 1000 to the rails 120 of the binding assembly. The locking member 1100 may be rotatably attached to the planar member 1002 at a pivot point 1101 which may be an axle disposed at a midpoint of the locking member 1000 and along the midline of the planar member 1002, the locking member 1100 extends outwards from the pivot point to two opposite handles 1102R and 1102L, accessible on either side. Inwards from the handles, are recessed portions 1104 which have a planar lower surface and a locking tab 1106 which defines a locking recess 1105 underneath it between the floor of the recess 1104 and an inner sidewall.

Figure 9A:
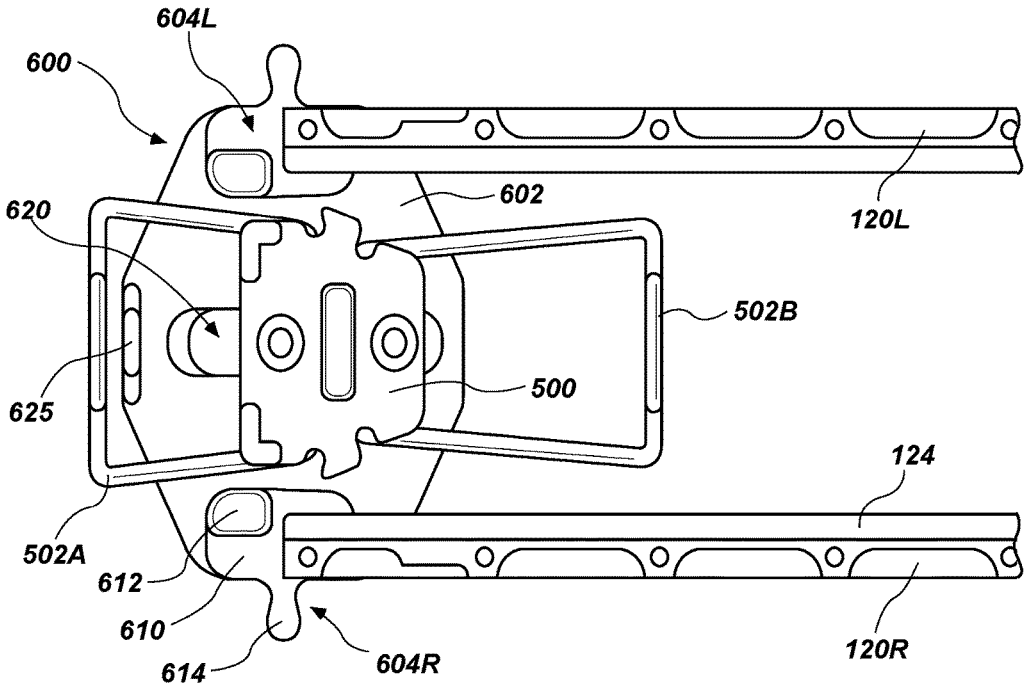
FIGS. 9A and 9B are top views of the heel bracket and sliding heel lock assembly of FIG. 1 in position with the bottom rails of the binding assembly.
Figure 9B:
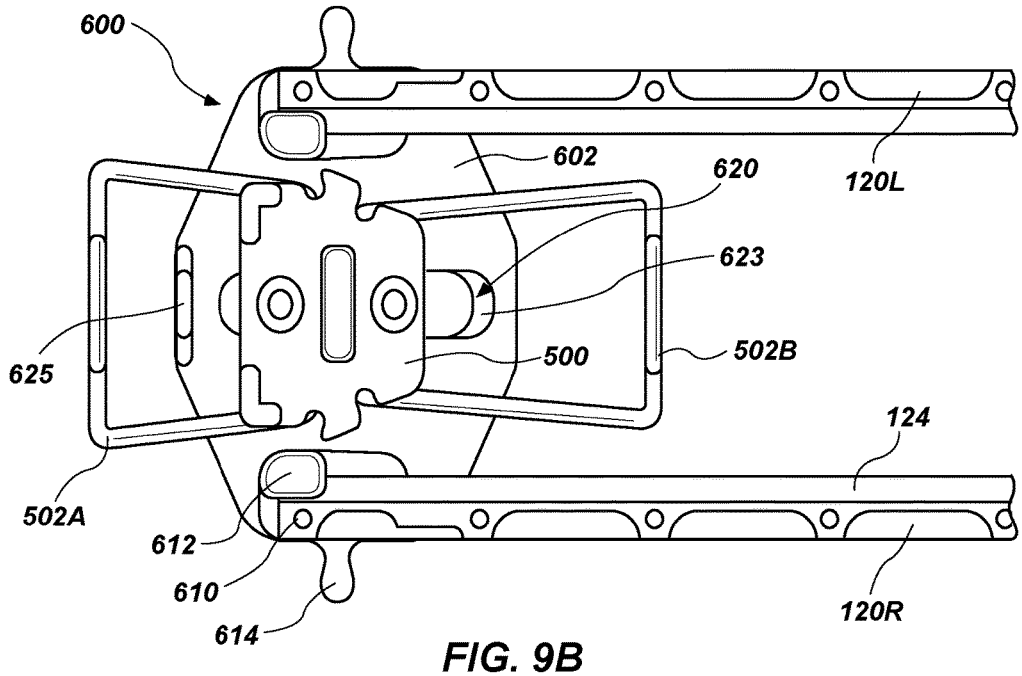

As depicted in FIG. 8B, for installation or removal, the locking member is rotated so the handles 1102R and 1102L are away from the side edges of the planar member 1002 moving the locking members 1106R and 1106L away from rails 120R and 120L. To secure the crampon 1000 to the binding 10, the handles 1102 are rotated to move the locking tabs 1106R and 1106L into the channels defined by the lower ledges 124 of the rails 120R and 120L. The crampon 1000 may then move as the binding 10 rotates during use.

Where a user desires to secure the heel of the binding 10 to the board BL or BR during ski mode use, a sliding heel lock assembly 600 may be used as depicted in FIGS. 9A and 9B. As depicted, the sliding heel lock assembly may be a member with a generally planar lower surface and a generally planar upper surface 602. A central slot 620 passes through the body of the member 600, allowing it to be installed around the mounting screws S of the heel bracket 500 with the planar lower surface adjacent the board BL or BR. At either short end of the central slot 20, a beveled surface 623 may be present.

At either side of the member 600, a raised locking mesa 604R or 604L may be disposed, with a planar upper surface 610. Each locking mesa may include a locking handle 614 formed as a sideward protrusion from the locking mesa 604. Each locking mesa may further include a rail locking tab 612 disposed on the planar surface as an upwards extension and defining a locking recess 613 with an undercut portion above the planar surface 610. A raised tab 625 may be disposed at the rear of the member 600 and may include holes for connection to a cord or other pulling structure.

The rail locking tabs 612R, 612L and corresponding recesses 613 are aligned with the rails 120R and 120L of a binding 10 installed over the heel bracket 500 in a ski mode. When the member 600 is slidably moved forward, the heel locking tab 612 moves over the rear end of ledge 124 of a rail 120, which enters recess 613. The member may then be retained on the rails by a friction fit. This may be assisted by a between the beveled edge 623 and a corresponding structure disposed in the lower surface of the heel bracket 500, or by another locking feature. The heels of the bindings are thus secured to the board, as depicted in FIG. 8B. To release the heel lock, the assembly 600 is slid rearward to release the rails as depicted in FIG. 9A.

While this disclosure has been described using certain embodiments, it can be further modified while keeping within its spirit and scope. This application is therefore intended to cover any variations, uses, or adaptations of the disclosure using its general principles. Further, this application is intended to cover such departures from the present disclosure as come within known or customary practices in the art to which it pertains and which fall within the limits of the appended claims.

What is claimed is:

1. A splitboard binding system, comprising:

a binding assembly comprising a base plate having a generally planar lower surface and a generally planar upper surface;

a first rail disposed on the lower surface of the base plate, the first rail disposed near a first longitudinal edge of the base plate and extending along an axis parallel to a long axis of the base plate, the first rail including a first lower ledge defining a planar surface parallel to the base plate and defining a first channel between the first lower ledge and the base plate for slidable connection to at least a first structure disposed on a splitboard;

a second rail disposed on the lower surface of the base plate, the second rail disposed near a second longitudinal edge of the base plate opposite the first longitudinal edge of the base plate, the second rail extending along an axis parallel to a long axis of the base plate and including a second lower ledge defining a planar surface parallel to the base plate and defining a second channel between the second lower ledge and the base plate for slidable connection to at least a first structure disposed on a splitboard;

a securing lever rotatably disposed near the rear end of the base plate and disposed over at least a portion of the base plate; and a least a first securing member disposed on the lower surface of the securing lever thereof, such that when the securing lever is rotated into a downwards position, a portion of the securing lever moves into a position adjacent to the upper surface of the base plate and at least a portion of the at least a first securing member is moved below the base plate to secure the binding to the at least a first structure disposed on the splitboard in slidable connection with the first channel and the second channel.

2. The splitboard binding system of claim 1, wherein the first channel and second channel are open at the rear of the binding to allow sliding installation on the at least a first structure disposed on the splitboard.

3. The splitboard binding system of claim 2, wherein the first rail includes a stop in the first channel to close the channel towards a front of the binding.

4. The splitboard binding system of claim 1, wherein the first rail and second rails each include a circular hook at a front end disposed in front of the base plate for rotatable attachment to a toe bracket.

5. The splitboard binding system of claim 1, wherein the securing lever rotatably disposed near the rear end of the base plate comprises a generally planar portion that is rotatably disposed over at least a portion of the base plate and at least a first side portion extending from the planar portion to a pivoting connection on a side of the binding, such that a user may rotate the securing lever downwards by stepping into the binding assembly, bringing the generally planar portion of the securing lever into contact with the upper surface of the base plate.

6. The splitboard binding system of claim 5, wherein the securing lever further comprises a release tab extending from the generally planar portion which extends rearwards from the base plate when in the lower position.

7. The splitboard binding system of claim 5, wherein the at least a first securing member passes through an opening in the base plate as the securing lever is rotated downwards.

8. The splitboard binding system of claim 5, wherein the at least a first structure disposed on the splitboard for slidable connection to the first and second channels comprises at least a first binding puck.

9. The splitboard binding system of claim 8, wherein the at least a first securing member has a front face that contacts a rear face on the at least a first binding puck to secure the binding on the binding puck.

10. The splitboard binding system of claim 1, further comprising a sliding heel lock assembly for locking the rear of the binding assembly to the splitboard when the binding assembly is attached to the splitboard in a ski mode, the sliding heel lock assembly comprising a locking member with a generally planar lower surface that its slidably mounted to the splitboard at a position underneath the rear of the first rail and second rail of the binding assembly with at least a first locking tab disposed on an upper surface of the locking member, the at least a first locking tab comprising a member that enters a rear opening of the first channel upon forward sliding to secure the first rail with the binding assembly in a lowered position.

11. The splitboard binding system of claim 10, wherein the sliding heel lock is disposed at least partially underneath a heel bracket.

12. The splitboard binding system of claim 1, further comprising a crampon assembly, the crampon assembly comprising a generally planar central section;

two opposite side sections each extending downwards from the generally planar central section; and at least a first locking mechanism for securing the crampon assembly to the first rail.

13. The splitboard binding system of claim 12, wherein the crampon assembly further comprises a connection member extending from a front edge of the generally planar central section and configured to connect to a toe bracket.

14. The splitboard binding system of claim 12, wherein the at least a first locking mechanism for securing the crampon assembly to the first rail comprises a locking member rotatably mounted to the generally planar central section, the locking member having at least a first locking tab, the locking tab sized and configured to enter the first channel as the locking member is rotated to secure the crampon assembly to the first rail.

15. The splitboard binding system of claim 14, wherein the at least a first locking mechanism for securing the crampon assembly to the first rail comprises a second locking member rotatably mounted to the generally planar central section, the second locking member having at least a second locking tab, the second locking tab sized and configured to enter the second channel as the locking member is rotated to secure the crampon assembly to the second rail.

16. A splitboard binding assembly, comprising:

a base plate having a generally planar lower surface and a generally planar upper surface;

a first rail and a second rail disposed on the lower surface of the base plate, the first rail and second rail disposed opposite one another and extending along either side of an axis parallel to a long axis of the base plate, each rail including a first lower ledge defining a planar surface parallel to the base plate to define opposite channels for slidable connection to at least a first structure disposed on a splitboard;

a securing lever rotatably disposed near the rear end of the base plate and disposed over at least a portion of the base plate; and a least a first securing member disposed on the lower surface of the securing lever thereof, such that when the securing lever is rotated into a downwards position, a portion of the securing lever moves into a position adjacent to the upper surface of the base plate and at least a portion of the at least a first securing member is moved below the base plate to secure the binding to the at least a first structure disposed on the splitboard in slidable connection with the first channel and the second channel.

17. The splitboard binding assembly of claim 1, wherein the opposite channels are open at the rear of the binding to allow sliding installation on the at least a first structure disposed on the splitboard.

18. The splitboard binding assembly of claim 16, wherein the securing lever rotatably disposed near the rear end of the base plate comprises a generally planar portion that is rotatably disposed over at least a portion of the base plate, at least a first side portion extending from the planar portion to a pivoting connection on a side of the binding, such that a user may rotate the securing lever downwards by stepping into the binding assembly, bringing the generally planar portion of the securing lever into contact with the upper surface of the base plate; and a release tab extending from the generally planar portion which extends rearwards from the base plate when in the lower position.

19. The splitboard binding assembly of claim 18, wherein the at least a first securing member passes through an opening in the base plate as the securing lever is rotated downwards.

20. The splitboard assembly system of claim 18, wherein the at least a first securing member has a front face that contacts the at least a first structure disposed on the splitboard for slidable connection with the opposite channels to secure the binding on the splitboard.

* * * * *